US012760599B2

(12) United States Patent
Puura et al.

(10) Patent No.: US 12,760,599 B2
(45) Date of Patent: Oct. 13, 2026

(54) APPARATUS AND A METHOD FOR MONITORING A ROCK DRILLING RIG

(71) Applicant: SANDVIK MINING AND CONSTRUCTION OY, Tampere (FI)

(72) Inventors: Jussi Puura, Tampere (FI); Henri Liikanen, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 0 days.

(21) Appl. No.: 19/112,762

(22) PCT Filed: Sep. 20, 2023

(86) PCT No.: PCT/EP2023/075966
§ 371 (c)(1),
(2) Date: Mar. 18, 2025

(87) PCT Pub. No.: WO2024/061981
PCT Pub. Date: Mar. 28, 2024

(65) Prior Publication Data

US 2026/0085582 A1 Mar. 26, 2026

(30) Foreign Application Priority Data

Sep. 20, 2022 (EP) ..... 22196739

(51) Int. Cl.
*E21B 7/02* (2006.01)

(52) U.S. Cl.
CPC ..... *E21B 7/022* (2013.01); *E21B 7/025* (2013.01)

(58) Field of Classification Search
CPC ..... E21B 7/024; E21B 7/022; E21B 7/025
See application file for complete search history.

(56) References Cited

U.S. PATENT DOCUMENTS

| | | | | |
|---|---|---|---|---|
| 8,033,208 | B2 * | 10/2011 | Joynt | F41H 7/042 296/193.07 |
| 11,242,746 | B2 * | 2/2022 | Yan | G01V 20/00 |
| 2020/0131737 | A1 | 4/2020 | Suzuki et al. | |
| 2024/0336463 | A1 * | 10/2024 | Finley | B66F 9/063 |

FOREIGN PATENT DOCUMENTS

| | | | |
|---|---|---|---|
| CN | 213478324 | U | 6/2021 |
| WO | 2014191013 | A1 | 12/2014 |

* cited by examiner

*Primary Examiner* — Catherine Loikith
(74) *Attorney, Agent, or Firm* — Corinne R. Gorski

(57) ABSTRACT

Example embodiments provide an apparatus for monitoring a rock drilling rig. The apparatus may be configured to determine a support pattern of the rock drilling rig and a total centre of gravity of the rock drilling rig. The rock drilling rig may be monitored based on a position of the total centre of gravity with respect to the support pattern. An apparatus, a method, and a computer program are also disclosed.

13 Claims, 3 Drawing Sheets

APPARATUS AND A METHOD FOR MONITORING A ROCK DRILLING RIG

RELATED APPLICATION DATA

This Application is a § 371 National Stage Application of PCT International Application No. PCT/EP2023/075966 Filed Sep. 20, 2023 Claiming Priority to EP 22196739.1 Filed
Sep. 20, 2022.

TECHNICAL FIELD

The present application generally relates to mining vehicles. In particular, some example embodiments of the present application relate to monitoring a rock drilling rig.

BACKGROUND

Mining vehicles may need to operate in cramped spaces underground. For example, an operator of the mining vehicle may need to move a large mining vehicle through narrow intersections in mines. The operator may need to steer and turn different parts of the mining vehicle such that the mining vehicle can fit through the intersection. It may be challenging to maintain stability of the mining vehicle when working in difficult ground conditions.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter.

Example embodiments may enable monitoring stability of the mining vehicle based on a total centre of gravity and a support pattern of the mining vehicle. An operator of the mining vehicle may be guided based on the monitored stability. Hence, safety and maneuverability of the mining vehicle may be improved.

According to a first aspect, there is provided an apparatus for monitoring a rock drilling rig comprising a plurality of structural components. The apparatus comprises at least one processor; and at least one memory comprising instructions which, when executed by the at least one processor, cause the apparatus to receive information on positions of the plurality of structural components of the rock drilling rig in relation to each other; receive mass properties of the plurality of structural components; determine a local centre of gravity of the plurality of structural components; determine a total centre of gravity of the rock drilling rig based on the local centre of gravity of the plurality of structural components, the mass properties of the plurality of structural components and information on positions of the plurality of structural components of the rock drilling rig in relation to each other; receive information on ground support members supporting the rock drilling rig, the information comprising at least positions of the ground support members; compute a support pattern of the rock drilling rig based on the information on the ground support members supporting the rock drilling rig; determine information on stability of the rock drilling rig based on a position of the total centre of gravity with respect to the support pattern; and output data on the stability of the rock drilling rig.

In an embodiment, the at least one memory further comprises instructions which, when executed by the at least one processor, cause the apparatus to receive information on a change of position of at least one first structural component of the plurality of structural components relative to at least one second structural component of the plurality structural of components; and update the total centre of gravity based on the information on the change of position.

In an embodiment, in addition or alternatively, the information on the change in position indicates at least one of translation movement or rotational movement of the first component relative to the second component.

In an embodiment, in addition or alternatively, the at least one memory further comprises instructions which, when executed by the at least one processor, cause the apparatus to receive information on a change in position of at least one of the ground support members; and update the support pattern based on the information on the change in position of the at least one ground support member.

In an embodiment, in addition or alternatively, the plurality of structural components comprises at least one carrier and at least one boom.

In an embodiment, in addition or alternatively, the plurality of structural components comprises two carriers and each carrier comprises a plurality of ground support members; and wherein the at least one memory further comprises instructions which, when executed by the at least one processor, cause the apparatus to compute the support pattern of the rock drilling rig based on the information on the ground support members supporting the rock drilling rig and positions of the carriers in relation to each other.

In an embodiment, in addition or alternatively, the at least one memory further comprises instructions which, when executed by the at least one processor, cause the apparatus to determine the information on stability of the rock drilling rig based on a distance between the total centre of gravity and at least one edge of the support pattern.

In an embodiment, in addition or alternatively, the at least one memory further comprises instructions which, when executed by the at least one processor, cause the apparatus to determine the information on stability of the rock drilling rig based on a support force per each ground support member supporting the rock drilling rig.

In an embodiment, in addition or alternatively, the at least one memory further comprises instructions which, when executed by the at least one processor, cause the apparatus to determine the information on stability of the rock drilling rig during operation of the rock drilling rig.

In an embodiment, in addition or alternatively, the ground support members supporting the rock drilling rig comprise at least one of tracks, wheels, a rear oscillation axle or ground support cylinders.

In an embodiment, in addition or alternatively, the at least one memory further comprises instructions which, when executed by the at least one processor, cause the apparatus to detect a risk of instability based on the information on stability of the rock drilling rig; and cause the rock drilling rig to at least one of limit velocity or stop when the risk of instability is detected.

In an embodiment, in addition or alternatively, the at least one memory further comprises instructions which, when executed by the at least one processor, cause the apparatus to detect the risk of instability based on the information on stability of the rock drilling rig indicating at least one of that a threshold value for distance between the position of the total centre of gravity and at least one edge of the support pattern is met or that the support force per ground support member is below a predetermined threshold.

In an embodiment, in addition or alternatively, the at least one memory comprises instructions which, when executed by the at least one processor, cause the apparatus to receive information indicative of a position of at least one tank of the rock drilling rig; receive information indicative of a fill level of the at least one tank; determine a mass of the at least one tank based on the fill level; determine a local centre of gravity of the at least one tank; and wherein the total centre of gravity is further based on the local centre of gravity of the at least one tank, the mass of the at least one tank and the position of the at least one tank.

According to a second aspect, there is provided a rock drilling rig comprising an apparatus according to the first aspect.

According to a third aspect, a computer-implemented method for monitoring a rock drilling rig comprising a plurality of structural components is provided. The method comprises receiving information on positions of the plurality of structural components of the rock drilling rig in relation to each other; receiving mass properties of the plurality of structural components; determining a local centre of gravity of the plurality of structural components; determining a total centre of gravity of the rock drilling rig based on the local centre of gravity of the plurality of structural components, the mass properties of the plurality of structural components and information on positions of the plurality of structural components of the rock drilling rig in relation to each other; receiving information on ground support members supporting the rock drilling rig, the information comprising at least positions of the ground support members; computing a support pattern of the rock drilling rig based on the information on the ground support members supporting the rock drilling rig; determining information on stability of the rock drilling rig based on a position of the total centre of gravity with respect to the support pattern; and outputting data on the stability of the rock drilling rig.

According to a fourth aspect, a computer program is provided, the computer program comprising instructions which, when executed by a computer, cause the computer to perform the method according to the second aspect.

Many of the attendant features will be more readily appreciated as they become better understood by reference to the following detailed description considered in connection with the accompanying drawings.

BRIEF DESCRIPTION OF THE DRAWINGS

The accompanying drawings, which are included to provide a further understanding of the example embodiments and constitute a part of this specification, illustrate example embodiments and together with the description help to explain the principles of the example embodiments. In the drawings.

Like references are used to designate like parts in the accompanying drawings.

DETAILED DESCRIPTION

Reference will now be made in detail to example embodiments, examples of which are illustrated in the accompanying drawings. The detailed description provided below in connection with the appended drawings is intended as a description of the present examples and is not intended to represent the only forms in which the present examples may be constructed or utilized. The description sets forth the functions of the example and a possible sequence of operations for constructing and operating the example. However, the same or equivalent functions and sequences may be accomplished by different examples.

Stability monitoring of a mining vehicle may be left to an operator. The operator may be aware of only some general inclination limits for the mining vehicle that cannot be crossed. Because of complexity of the issue, the operator may be instructed that some parts of the mining vehicle cannot be moved from their nominal positions during driving or tramming. A nominal position may refer to a predefined position of a part with respect to the mining vehicle, where the predefined position enables stable driving or tramming. The nominal position may be also referred to as an unadjusted position of the part. The part may be at least partially moved to another position from the nominal position, for example, for performing a task. Further, the operator may be instructed not to move a part from the nominal position of the part when ground support cylinders of the mining vehicle are not in ground contact. However, to move mining vehicles through narrow intersections in a mine, for example, booms of a mining vehicle may need to be turned. Fitting through corners may be hard or even impossible without turning the booms. When turning the booms, there is a tipping hazard for the mining vehicle.

Figure 1:
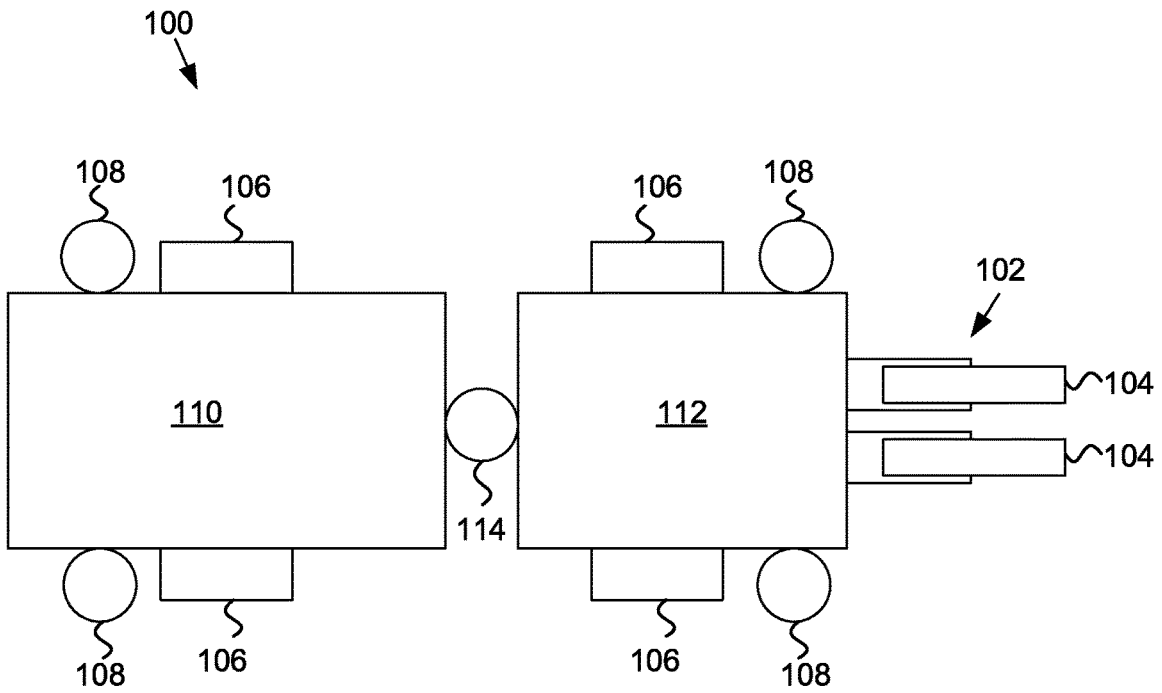
FIG. 1 illustrates an example of a mining vehicle according to an example embodiment.

The mining vehicle may be, for example, a rock drilling rig 100 as illustrated in FIG. 1. The rock drilling rig 100 may comprise a plurality of structural components. The plurality of structural components may comprise, for example, at least one carrier, and/or at least one boom. The at least one carrier may comprise, for example, a first carrier 112 such as a front carrier and a second carrier 110 such as a rear carrier. A front carrier may comprise a first carrier in a forward driving direction. A rear carrier may comprise a carrier following the front carrier in the forward driving direction. The first and the second carriers 112, 110 may be coupled via an articulation joint 114. Hence, the first and the second carriers 112, 110 may move relative to each other when the rock drilling rig 100 is steered. Steering a rock drilling rig may comprise, for example, causing a change of position of the rock drilling rig from a first position to a second position. A change of position may comprise, for example, movement of the rock drilling rig in a particular direction and/or a change of orientation of the rock drilling rig. The first and the second carrier 112, 110 may move relative to each other such that a location of the first carrier 112 may change in relation to a location of the second carrier 110 within limits of the articulation joint 114. The location of the first carrier 112 may change, for example, to the right or left with respect to the driving direction in relation to the second carrier 110. Further, an inclination level of the first carrier 112 may change in relation to an inclination level of the second carrier 110. The inclination level of the first carrier 112 may change, for example, to the right or left with respect to the driving direction, or up and down in relation to the second carrier 110.

The rock drilling rig 100 may comprise a plurality of ground support members such as wheels, tracks and/or ground support cylinders. The rock drilling rig 100 may comprise a plurality of wheels 106 coupled with the carriers 112, 110 for moving the rock drilling rig. Alternatively, the rock drilling rig 100 may comprise tracks for moving the rock drilling rig. The rock drilling rig 100 may further comprise a plurality of ground support cylinders 108 mounted on at least one carrier 112, 110. The ground support cylinders 108 may comprise ground jacks. A ground support member may be configured to provide support for a mining vehicle such as the rock drilling rig 100 when the ground support members are in ground contact. In addition, a ground support member may be configured to aid in maintaining the ground contact of other ground support members. In an embodiment, the rock drilling rig 100 may further comprise an oscillation axle such as a rear oscillation axle configured to aid, for example, the wheels to maintain contact with the ground on an uneven ground.

Although depicted as a rock drilling rig, the mining vehicle may be any type of a mining vehicle such as a bolting rig or a loader, for example. In general, a mining vehicle may comprise one or more carriers and ground support members. In an embodiment, the mining vehicle may comprise operating equipment for performing certain tasks in mines. The tasks may be related to, for example, drilling, bolting, mesh installation, maintenance, or supply. The operating equipment may be coupled, for example, to the first carrier 112 or to the second carrier 110. The operating equipment may protrude from the mining vehicle at any suitable direction, for example in a first direction such as a forward driving direction or a second direction such as a backward driving direction of the mining vehicle. The operating equipment may have changeable dimensions, such that the operating equipment may be configured to move in relation to at least one other component of the mining vehicle. Further, positions of components of the operating equipment may be changed in relation to each other. The operating equipment may be mounted, for example, on the first carrier 112 or the second carrier 110, or both, depending on a use case. The operating equipment may comprise, for example, one or more movable arms such as one or more booms or one and/or more robotic arms.

In an embodiment, the rock drilling rig 100 may comprise at least one boom, for example, at least one extendable boom and/or at least one non-extendable boom. In an embodiment, the rock drilling rig 100 may comprise a plurality of booms.

A boom may be provided with a mining work tool. A mining work tool may comprise one or more devices used in underground or surface mining. A mining work tool may comprise, for example, a rock drilling unit, a bolting head, or a bucket.

A boom may be configured to move between different working positions. A working position may comprise, for example, a transport position into which position the boom is moved for moving the mining vehicle from a first location to a second location. As another example, a working position may comprise an operating position for operating, for example, a rock drilling unit provided at a distal end of the boom. As a further example, a working position may comprise an operating position for bucket filling.

A mining vehicle such as the rock drilling rig 100 may comprise two booms 104 as illustrated in the example of FIG. 1. A boom 104 may comprise an adjustable arm projecting, for example, from a the first carrier 112 or the second carrier 110. A boom 104 may be configured to move in a plurality of degrees of freedom. The plurality of degrees of freedom may comprise, for example, six degrees freedom (6DoF). A boom 104 may comprise a plurality of boom components movable in relation to each other. The boom components may be configured to perform at least one of the following: provide a base for one or more other components, enable extending reach of one or more other components, or perform an operation such as rock drilling. The plurality of boom components may comprise a component at the front end or the rear end of the boom, an inner/outer tube of a telescopic boom component, component between a carrier and a feed swing axis, a roll-over joint, a swing joint, a cross piece of a cradle, or a drilling feed component, for example. A rear end of the boom may comprise a first end of the boom connected to the first carrier 112 or the second carrier 110, and the front end of the boom may comprise a second end of the boom connected to a mining work tool. The components may be coupled via a plurality of joints. The joints may comprise at least one of a swing, a lift, a feed tilt, a feed swing or a crossing of the roll-over and bolting axes. Hence, dimensions of the booms 104 may be adjusted by changing relative positions of the components via the joints.

A mining vehicle, such as the rock drilling rig 100, may comprise a plurality of sensors. The plurality of sensors may be configured to measure at least one of translational or rotational movement of at least one structural component of the rock drilling rig 100. The plurality of sensors may be configured to measure relative positions of a plurality of structural components. The plurality of sensors may be configured to measure a plurality of joint angles of the rock drilling rig 100. At least one sensor may be configured to measure, for example, a pitch angle of the rock drilling rig 100 and/or any of the plurality of structural components such as the boom 104. At least one sensor may be configured to measure, for example, a roll angle of the rock drilling rig 100 and/or any of the plurality of structural components such as the boom 104. As a further example, at least one sensor may be configured to measure an articulation angle of the rock drilling rig 100. The articulation angle of the rock drilling rig 100 comprises an angle between a first carrier 112 of the rock drilling rig and a second carrier 110 of the rock drilling rig. An angle between the first carrier 112 and the second carrier 110 may comprise a yaw angle.

Figure 2:
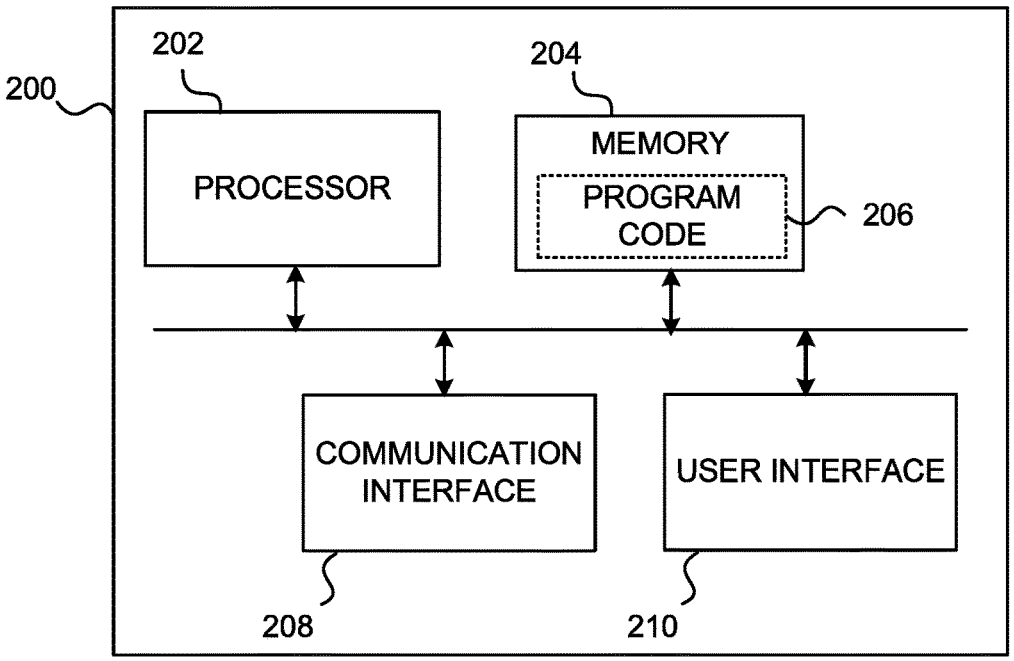
FIG. 2 illustrates an example of an apparatus for monitoring a rock drilling rig, according to an example embodiment.

A mining vehicle such as the rock drilling rig 100 may further comprise an apparatus for monitoring the rock drilling rig 100. Monitoring the rock drilling rig 100 may comprise, for example, monitoring stability of the rock drilling rig 100. The apparatus may be any suitable device configured to monitor stability of a rock drilling rig. An example of such an apparatus is illustrated in FIG. 2. The apparatus 200 may be configured to communicate with one or more devices such as one or more sensors of the rock drilling rig 100. Communicating with a device may comprise receiving information from the device and/or transmitting information to the device. The apparatus 200 may be configured to determine information on stability of the rock drilling rig 100. The apparatus 200 may be configured to determine information on stability of the rock drilling rig 100 based on received information. Receiving the information may comprise, for example, receiving measurement data relating to the stability of the rock drilling rig 100 or measuring the stability of the rock drilling rig 100.

The apparatus 200 may be configured to receive data from the plurality of sensors. The data may comprise measurement data relating to a position or movement of any of the structural components such as at least one of the first carrier 112, the second carrier 110, or one or more boom components of the one or more booms 104. The apparatus 200 may be configured to determine a position of the first carrier 112, the second carrier 110 or the one or more boom components in relation to at least one of the first carrier 112, the second carrier 110 or at least one other component based on the received data. The apparatus 200 may be configured to store data indicative of the relative positions of the one or more carriers 112, 110 and/or boom components of the one or more booms 104. The apparatus 200 may be configured to receive data indicative of the relative positions of the carriers 112, 110 from one or more sensor. Data received from the one or more sensors may be, however, processed, for example by the apparatus, to obtain the data indicative of the relative positions of the carriers 112, 110. In an embodiment, the relative positions of the first and second carriers 112, 110 may be obtained by the apparatus 200 in real time based on sensor data from a sensor associated with the articulation joint 114. Based on the sensor data and the relative positions, the apparatus 200 may be configured to determine positions of the different parts of the mining vehicle in relation to each other in real time. Alternatively, the apparatus 200 may be configured to determine relative positions at predetermined intervals. Alternatively, the apparatus 200 may be configured to determine the relative positions in response to the apparatus 200 detecting, based on the sensor data, movement of the structural components such as the one of the carriers 112, 110 and/or boom components of the booms 104.

In an embodiment, the apparatus 200 may be configured to receive information on the plurality of structural components. Information on the plurality of structural components may comprise information on a status of a structural component and/or information on at least one property of a structural component such as information on a positions of a structural component of the rock drilling rig 100, information on mass properties of a structural component and/or information on a local centre of gravity of a structural component. The apparatus 200 may be configured to store data on the local centre of gravity and mass properties of the at least one carrier such as the carriers 112, 110 and the boom components of the booms 104. Alternatively, the apparatus 200 may be configured to determine the local centre of gravity of a structural component based on information on mass properties. The mass properties may comprise at least a mass of the structural component.

A local centre of gravity comprises a point at which the weight of a body may be considered as concentrated so that if supported at the point, the body would remain in equilibrium. Therefore, the local centre of gravity of a structural component may comprise a point at which the weight of the structural component may be considered as concentrated.

As explained above, a structural component may comprise at least one carrier, such as the first carrier 112 and/or the second carrier 110, at least one boom 104, and boom components of the at least one boom 104. A structural component may further comprise, for example, one or more tanks of the rock drilling rig 100.

The apparatus 200 may be configured receive positions of the structural components, for example, from one or more internal systems of the rock drilling rig 100. For example, the rock drilling rig 100 may comprise a boom system 102 comprising a boom base and the booms 104. The boom base may be configured to provide a base to which moving boom components of the booms 104 may be attached to. The boom system 102 may be configured to compute forward kinematics of the booms 104. In general, computing forward kinematics may refer to a process of obtaining a position and a velocity of an object, given the known joint angles and angular velocities. The forward kinematics may enable to determine a position and orientation of the booms 104 based on joint values associated with the booms 104. Hence, the boom system 102 may be configured to automatically position the booms 104. Based on the forward kinematics, a 6DOF (six-degrees of freedom) transformation matrix of each moving boom component may be computed by the boom system 102. The transformation matrix may be used to express data in one coordinate system in relation to another coordinate system. Each structural component of the rock drilling rig 100 may comprise a local coordinate system, for example based on a joint associated with the structural component. For example, a coordinate vector associated to a structural component may be multiplied with the transformation matrix expressing a rotational and translational movement of the structural component between the coordinate systems. By computing the forward kinematics from a base coordinate system to a structural component of interest, data provided in other coordinate systems can be expressed in the base coordinate system. For example, local center of gravities of all structural components may be expressed in a coordinate system of the carrier 110, 112 for computation of a total center of gravity of the rock drilling rig 100. In addition to information about every boom component in relation to the boom base, the positions of the booms 104 may be known in relation to the carriers 112, 110 based on the forward kinematics. The boom system 102 may be configured to provide the 6DOF transformation matrices of each moving boom component of the booms 104 to the apparatus 200. In an embodiment, the apparatus 200 may be configured to receive the positions of the booms 104 from the boom system 102. Alternatively, the apparatus 200 may be configured to compute the positions of the booms 104 based on forward kinematics received from the boom system 102. Further, the centre of gravity and mass of each boom component may be obtained by the apparatus 200, for example, from a computer-aided design (CAD) system used for modelling the rock drilling rig 100.

In an embodiment, the apparatus 200 may be configured to receive 6DOF transformation matrices of each carrier 112, 110 of the rock drilling rig 100 from a tramming system of the rock drilling rig 100. A tramming system of the rock drilling rig may be configured to move the rock drilling rig 100. Based on the 6DOF transformation matrices, the apparatus 200 may be configured to determine a position and an orientation of the first carrier 112 and the second carrier 110 in relation to the other structural components. Instead of using transformation matrices, the rotational and translational information of positions of the structural components may also be received by the apparatus 200 as quaternions or roll, pitch and yaw angles, or as xyz translations from the one or more internal systems. Further, the apparatus 200 may be configured to receive information on the local centre of gravity and mass properties of each carrier. The local centre of gravity and mass properties of each carrier may be received, for example, from the CAD design system used for modelling the rock drilling rig 100.

In an embodiment, the mining vehicle may be an automated mining vehicle. An automated mining vehicle may be configured to perform a task autonomously. For example, an automated mining vehicle may comprise an autonomous driving system. In an embodiment, the mining vehicle may be an automated rock drilling rig 100. In case of an automated mining vehicle, positions of the structural components may be known by a control system of the mining vehicle for control purposes in real time based on data from associated sensors. For example, in case of an autonomous driving system, the relative positions may be determined for autonomous path following control by the autonomous driving system. The apparatus 200 may be configured to obtain information on the relative positions of the structural components from the control system of the mining vehicle, such as the autonomous driving system.

In an embodiment, the rock drilling rig 100 may comprise one or more structural components having varying characteristic(s). For example, the rock drilling rig 100 may comprise a tank having a varying mass. A tank may comprise, for example, at least one of an onboard water tank, a fuel tank or a hydraulic fluid tank. A tank having varying characteristics may comprise a fill level sensor. The apparatus 200 may be configured to receive fill level sensor readings and estimate a mass of the respective tank in real time based on the fill level sensor readings. Further, the apparatus 200 may be configured to obtain a centre of gravity of a tank, for example, from the CAD design system used for modelling the rock drilling rig 100.

According to an example embodiment the apparatus 200 is configured to monitor stability of a mining vehicle by comparing a computed support pattern and a determined total centre of gravity of the mining vehicle. The apparatus 200 may be configured to perform the monitoring in real time. In an embodiment, the apparatus 200 may be configured to perform the monitoring during operation of the mining vehicle. In addition, data on the stability may be output to an operator of the mining vehicle as a visual or audible signal for helping the operator to steer the mining vehicle under different conditions such that tipping over may be avoided. Hence, structural components of the mining vehicle, such as booms or robotic arms, may be moved during driving or tramming without fear of losing stability as long as the provided data on stability indicates that the mining vehicle remains stable. The mining vehicle may therefore be driven even in very small intersections and turning the booms while driving as the operator may be aware of how movements of the booms affect the stability based on the provided information on stability. A difficult topic of stability may be visualized to the operator to provide a driver assistance feature. If the stability of the mining vehicle approaches a stability limit, the operator may be able to smoothly stop the mining vehicle or limit speed of the mining vehicle to prevent reaching the stability limit. The stability limit may indicate a limit, for example in terms of boom position(s), after which the mining vehicle may become unstable and tip-over. The apparatus 200 may be configured to monitor stability limits based on a distance between the total centre of gravity and at least one edge of a support pattern.

FIG. 2 illustrates an example of an apparatus for monitoring a rock drilling rig, according to an example embodiment. Monitoring the rock drilling rig may comprise, for example, monitoring stability of the rock drilling rig.

The apparatus 200 may comprise at least one processor 202. The at least one processor 202 may comprise, for example, one or more of various processing devices, such as for example a co-processor, a microprocessor, a controller, a digital signal processor (DSP), a processing circuitry with or without an accompanying DSP, or various other processing devices including integrated circuits such as, for example, an application specific integrated circuit (ASIC), a field programmable gate array (FPGA), a microcontroller unit (MCU), a hardware accelerator, a special-purpose computer chip, or the like.

The apparatus 200 may further comprise at least one memory 204. The memory 204 may be configured to store, for example, computer program code 206 or the like, for example operating system software and application software. The memory 204 may comprise one or more volatile memory devices, one or more non-volatile memory devices, and/or a combination thereof. For example, the memory may be embodied as magnetic storage devices (such as hard disk drives, magnetic tapes, etc.), optical magnetic storage devices, or semiconductor memories (such as mask ROM, PROM (programmable ROM), EPROM (erasable PROM), flash ROM, RAM (random access memory), etc.).

The apparatus 200 may further comprise a communication interface 208 configured to enable the apparatus 200 to transmit and/or receive information, to/from other devices. The devices may comprise, for example, sensors configured to monitor movement and positions of a plurality of structural components of the mining vehicle The communication interface 208 may be configured to provide at least one wireless radio connection, such as for example a 3GPP mobile broadband connection (e.g., 3G, 4G, 5G). However, the communication interface 208 may be configured to provide one or more other types of connections, for example, a wireless local area network (WLAN) connection such as, for example, standardized by IEEE 802.11 series or Wi-Fi alliance; a short range wireless network connection such as for example a Bluetooth, NFC (near-field communication), or RFID connection; a wired connection such as for example a local area network (LAN) connection, a universal serial bus (USB) connection or an optical network connection, or the like; or a wired Internet connection. The communication interface 208 may comprise, or be configured to be coupled to, at least one antenna to transmit and/or receive radio frequency signals. One or more of the various types of connections may be also implemented as separate communication interfaces, which may be coupled or configured to be coupled to a plurality of antennas.

The apparatus 200 may comprise a user interface 210. The user interface 210 may comprise at least one of an input device or an output device. The input device may take various forms such a keyboard, a touch screen, or one or more embedded control buttons. The output device may for example comprise a display, a haptic device, or a speaker. The apparatus 200 may be configured to output data on stability of the mining vehicle to an operator via the output device. The data may be provided as at least one of a visual signal, a haptic feedback, or an audible signal.

The apparatus 200 may comprise for example a server device, a client device, a mobile phone, a tablet computer, a laptop, or the like. In an embodiment, the apparatus 200 may comprise a control device of a mining vehicle. In an embodiment, the apparatus 200 may comprise a plurality of sensors. In an embodiment, the apparatus 200 may comprise a tramming system of the mining vehicle. In an embodiment, the apparatus 200 may comprise a boom system of the mining vehicle. In an embodiment, the apparatus 200 may comprise an autonomous driving system of the mining vehicle. In an embodiment, the apparatus 200 may comprise the mining vehicle. In an embodiment, the apparatus 200 may comprise a rock drilling rig. Although the apparatus 200 is illustrated as a single device it is appreciated that, wherever applicable, functions of the apparatus 200 may be distributed to a plurality of devices.

When the apparatus 200 is configured to implement some functionality, some component and/or components of the apparatus 200, such as for example the at least one processor 202 and/or the memory 204, may be configured to implement this functionality. Furthermore, when the at least one processor 202 is configured to implement some functionality, this functionality may be implemented using program code 206 comprised, for example, in the memory 204.

The functionality described herein may be performed, at least in part, by one or more computer program product components such as software components. According to an embodiment, the apparatus 200 comprises a processor 202 or processor circuitry, such as for example a microcontroller, configured by the program code 206 when executed to execute the embodiments of the operations and functionality described. Alternatively, or in addition, the functionality described herein can be performed, at least in part, by one or more hardware logic components. For example, and without limitation, illustrative types of hardware logic components that can be used include Field-programmable Gate Arrays (FPGAS), application-specific Integrated Circuits (ASICS), application-specific Standard Products (ASSPs), System-on-a-chip systems (SOCs), Complex Programmable Logic Devices (CPLDs), Graphics Pro-cessing Units (GPUS).

The apparatus 200 comprises means for performing at least one method described herein. In one example, the means comprises the at least one processor 202, the at least one memory 204 including instructions which, when executed by the at least one processor 202, cause the apparatus 200 to perform the method.

Figure 3:
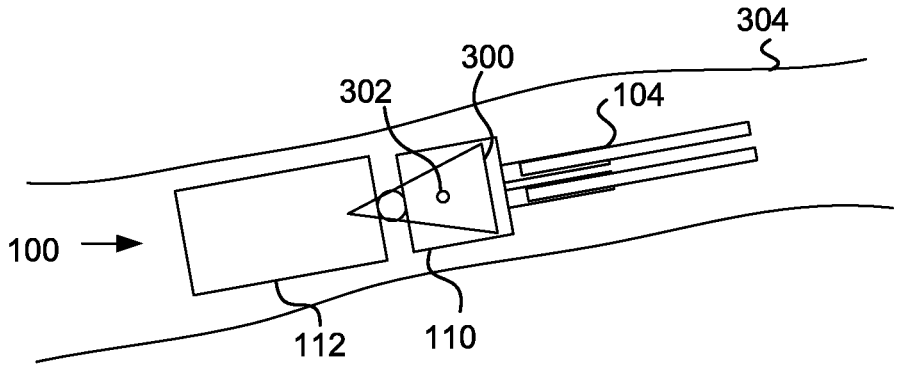
FIG. 3 illustrates an example of monitoring a rock drilling rig in a mine, according to an example embodiment.

FIG. 3 illustrates an example of monitoring a rock drilling rig in a mine, according to an example embodiment. Monitoring the rock drilling rig may comprise, for example, monitoring stability of the rock drilling rig. The rock drilling rig 100 may comprise the apparatus 200 of FIG. 2 for monitoring the stability.

The apparatus 200 may be configured to determine a support pattern 300 and a total centre of gravity 302 of the mining vehicle for monitoring stability of the mining vehicle. A total centre of gravity comprises a point at which the weight of a body may be considered as concentrated so that if supported at the point, the body would remain in equilibrium. Therefore, the total centre of gravity may comprise a point at which the total weight of the rock drilling rig 100 may be considered as concentrated.

The support pattern may comprise an area formed with respect to the rock drilling rig 100 based on locations of ground support members of the rock drilling rig 100 in contact with the ground. An area defined based on locations of ground support members may comprise an area, where corners of the support area are determined based on the positions of the ground support members. In an embodiment, the apparatus 200 may be configured to receive information on positions of a plurality of structural components of the rock drilling rig 100 in relation to each other.

In an embodiment, the structural components may comprise one or more carriers. In an embodiment, the structural components may further comprise one or more booms. The apparatus 200 may be further configured to receive mass properties of the plurality of structural components. In addition, the apparatus 200 may be configured to determine a local centre of gravity of the plurality of structural components. The apparatus 200 may be configured to determine a total centre of gravity 302 of the rock drilling rig based on a local centre of gravity of the plurality of structural components, the mass properties of the plurality of structural components and information on positions of the plurality of structural components of the rock drilling rig in relation to each other.

The apparatus 200 may be configured to receive information on ground support members supporting the rock drilling rig, the information comprising at least positions of the ground support members. The information may be received from a plurality of sensors mounted on the mining vehicle. The apparatus 200 may be configured to compute the support pattern 300 of the rock drilling rig based on the information on the ground support members supporting the rock drilling rig. Further, the apparatus 200 may be configured to determine information on stability of the rock drilling rig based on a position of the total centre of gravity 302 with respect to the support pattern 300. The apparatus 200 may be configured to use the information on stability of the mining vehicle to output data on the stability of the rock drilling rig 100.

In an embodiment, the apparatus 200 may comprise a plurality of carriers. Each carrier of the plurality of carriers may comprise a plurality of ground support members. The apparatus 200 may be configured to compute the support pattern 300 of the rock drilling rig 100 based on the information on the ground support members supporting the rock drilling rig and positions of the carriers in relation to each other. Positions of the carriers, as they move in relation to each other via the articulation joint, may influence the support pattern 300 when the ground support members mounted on the different carriers move relative to each other.

The support pattern 300 may form a polygon. In general, the support pattern 300 may be determined based on each ground support member which are in ground contact or which aid at least some of the ground support members to maintain the contact with the ground. If the rock drilling rig 100 is equipped with ground support cylinders, positions of the ground support cylinders may be known for example from CAD design systems and drawings of the rock drilling rig. The ground support cylinders may be equipped with pressure sensors indicating if the ground support cylinders are in ground contact. The apparatus 200 may be configured to receive an indication that one or more of the ground support cylinders are in ground contact. Hence, the apparatus 200 may be configured to include, in response to receiving the indication from the one or more pressure sensors, the one or more ground support cylinders in the support pattern 300. Otherwise, the wheel or track locations may be used. In case the rock drilling rig 100 comprises a rear oscillating axle, the apparatus 200 may be configured to use the centre of the rear oscillating axle in the support pattern 300 instead of rear wheel locations. For example, in FIGS. 3 and 4 the support pattern 300 may form a triangle based on locations of front wheels of the rock drilling rig 100 and the centre of the rear oscillation axle.

As explained above, the mining vehicle may comprise one or more tanks having a variable mass. The apparatus 200 may be configured to receive information indicative of a position of at least one tank of the rock drilling rig and information indicative of a fill level of the at least one tank. The apparatus 200 may be configured to determine a mass of the at least one tank based on the fill level. The apparatus 200 may be further configured to obtain a local centre of gravity of the at least one tank. The apparatus 200 may be configured to determine the total centre of gravity 302 further based on the local centre of gravity of the at least one tank, the mass of the at least one tank and the position of the at least one tank.

In an embodiment, the information on stability of the rock drilling rig 100 may be determined based on a distance between the total centre of gravity 302 and at least one edge of the support pattern 300. In the situation illustrated in FIG. 3, the rock drilling rig 100 may be moving in a substantially straight tunnel portion of the mine 304. Hence, the booms 104 may be in a nominal position. As illustrated in FIG. 3, the total centre of gravity 302 is located near the centre of the support pattern 300. The apparatus 200 may be configured to determine that the rock drilling rig 100 is in a stable position when distance between the total centre of gravity 302 and edges of the support pattern 300 is above a threshold value. In an embodiment, the apparatus 200 may be configured to determine that the rock drilling rig 100 is in a stable position when distance between the total centre of gravity 302 and an edge closest to the total centre of gravity 302 is above the threshold value. The situation may change in response to a movement of the rock drilling rig 100 along the tunnel portion of the mine, changed position of at least one boom 104, and/or when ground support is changed from wheels to ground support cylinders or vice versa, for example. The apparatus 200 may be configured to update at least one of the total centre of gravity 302 and/or the support pattern 300 in response to a trigger event. The trigger event may comprise, for example, a change of position of at least one structural component of the rock drilling rig 100 or a change in ground support members being in contact with the ground. Updating the total centre of gravity 302 may comprise, for example, determining the total centre of gravity 302 based on information on a change of position of at least one structural component of the plurality of structural components in relation to at other structural components. Updating the support pattern 300 may comprise, for example, recomputing the support pattern 300 based on information on a change in the ground support members supporting the rock drilling rig 100.

When positions of different structural components of the rock drilling rig 100 change in relation to each other, the total centre of gravity 302 may be re-determined by the apparatus 200. Further, when at least one of the ground support members in contact with the ground changes, the support pattern 300 may be recomputed. If the distance between the total centre of gravity 302 and at least one edge of the support pattern 300 reaches the threshold value in response to a change of position of at least one structural component in relation to other structural components or in response to a change of ground contact of the ground support members, the apparatus 200 may be configured to provide a warning to an operator of the rock drilling rig 100. The distance between the total centre of gravity 302 and at least one edge of the support pattern 300 may be determined based on a distance from at least one edge of the support pattern 300 to the total centre of gravity 302. Alternatively, the distance between the total centre of gravity 302 and at least one edge of the support pattern 300 may be determined based on a distance from the total centre of gravity 302 to at least one edge of the support pattern 300. In addition, or alternatively, the apparatus 200 may be configured to monitor and provide a different warning to the operator when the total centre of gravity 302 approaches or reaches one of the edges of the support pattern 300.

For example, when the rock drilling rig 100 arrives to an intersection or a corner in the mine 304, the operator may need to move the booms 104 such that it is possible for the rock drilling rig 100 to fit the turn.

Figure 4:
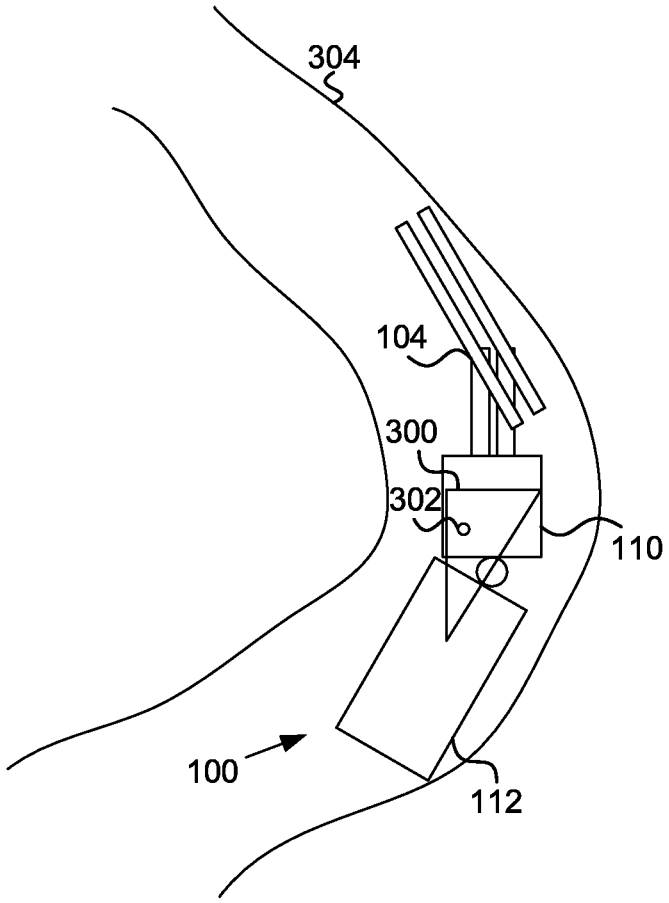
FIG. 4 illustrates an example of monitoring a rock drilling rig in an intersection of a mine, according to an example embodiment.

FIG. 4 illustrates an example of monitoring a rock drilling rig 100 in such a situation, according to an example embodiment. Monitoring the rock drilling rig may comprise, for example, monitoring stability of the rock drilling rig.

When the mining vehicle, such as the rock drilling rig 100, is steered to turn, positions of the first and the second carriers 112, 110 change relative to each other according to an articulation angle of the articulation joint 114. Further, positions of the booms 104 in relation to the first and second carriers 112, 110 change. In addition, positions of components of the booms 104 relative to each other may change. Therefore, both the support pattern 300 and the location of the total centre of gravity 302 within the support pattern 300 may change. In comparison to FIG. 3, in the example situation of FIG. 4 the apparatus 200 is configured to recompute the support pattern 300 in response to the changed relative positions of the structural components of the rock drilling rig 100. Further, the total centre of gravity 302 is now located closer to the edges of the support pattern 300 than in the example of FIG. 3.

The apparatus 200 may be configured to continuously output data on a current situation of the stability of the mining vehicle 100 to the operator based on the position of the total centre of gravity 302 within the support pattern 300. Hence, the operator may be able to control the mining vehicle 100 such that stability of the mining vehicle 100 is maintained. For example, based on a warning provided by the apparatus 200, the operator may know when to stop the mining vehicle 100. Alternatively, the operator may be guided by a warning to limit speed of the mining vehicle 100. Hence, moving to the stability limit of the rock drilling rig due to movement of the rock drilling rig may be avoided. If the stability limit were reached, the mining vehicle could become unstable. The stability limit may correspond to a predetermined distance between the total centre of gravity 302 and an edge of the support pattern 300. Alternatively, or in addition, a stability limit may be reached when a position of the total centre of gravity 302 with respect to the support pattern 300 has reached an edge of the support pattern 300. The stability limit may be thus provided, for example, as a minimum allowed distance between at least one edge (e.g. the closest edge) of the support pattern and the total centre of gravity. Alternatively, the stability limit may be provided as positions of the edges of the support pattern, which the total centre of gravity is not allowed to cross. In an embodiment, the output data may comprise position of the entire rock drilling rig 100, and the support pattern 300 and the total centre of gravity 302 in relation to the rock drilling rig. In an embodiment, the output data may comprise a visual indication of an approached or reached stability limit. In an embodiment, the output data may comprise an audible indication of the reached stability limit.

In an embodiment, the apparatus 200 may be configured to receive data indicative of a change of position of at least one first structural component of the plurality of structural components relative to at least one second structural component of the plurality of structural components. For example, the first structural component may comprise a first carrier and the second structural component may comprise a second carrier. For example, the first structural component may comprise at least one boom and the second structural component may comprise the first carrier or the second carrier. For example, the first structural component and the second structural component may be different boom components of the at least one boom. The apparatus 200 may be configured to update the total centre of gravity 302 based on received information on the change of position of the first structural component in relation to the second structural component. The information on the change of position may comprise at least one of translational or rotational movement of the respective component. The apparatus 200 may be configured to receive the information on the change of position, for example, from a sensor monitoring a joint associated with the respective component.

In an embodiment, the apparatus 200 may be configured to receive data indicative of a change of position of at least one of the ground support members supporting the rock drilling rig 100. The position of at least one of the ground support members may have changed, for example, in relation to the first carrier or the second carrier. Alternatively, a position of one of the ground support members may have changed when a ground jack of the mining vehicle is activated and placed in contact with the ground, or deactivated and lifted from the ground. The apparatus 200 may be configured to receive information on activated ground jacks, for example, from a pressure sensor associated with the ground jack. In an embodiment, the change in a position of at least one of the ground support members supporting the rock drilling rig 100 may be measured via pressure in a ground support hydraulic cylinder chamber indicating weight on the ground support cylinder. Alternatively, the change in a position could be measured with an inductive switch based on motion of the ground support cylinder carrying weight. Thereafter, the apparatus 200 may be configured to update the support pattern 300 based on the data indicative of the change in position of the at least one ground support member.

In an embodiment, the information on stability of the rock drilling rig may be determined by the apparatus 200 based on a support force per each ground support member supporting the rock drilling rig 100. The apparatus 200 may be configured to determine the support force per each ground support member. The apparatus 200 may be configured to determine information on stability based on the determined support force, the support pattern 300 and on the position of total centre of gravity 302 with respect to the support pattern 300. If the support force of any of the ground support members goes below a predetermined threshold, stability of the rock drilling rig 100 may be lost.

In an embodiment, the apparatus 200 may be configured to detect a risk of instability. The risk of instability may comprise a risk for the rock drilling rig 100 to overturn or tip-over. The apparatus 200 may be configured to detect the risk of instability based on the information on stability indicating that the support force per ground support member is below the predetermined threshold. The apparatus 200 may be configured to cause the rock drilling rig to at least one of stop or limit velocity of the rock drilling rig 100 when the support force is below the predetermined threshold.

In an embodiment, the apparatus 200 may be configured to detect the risk of instability when the information on stability of the rock drilling rig indicates that a predetermined distance between the position of the total centre of gravity 302 and at least one edge of the support pattern 300 is met. The apparatus 200 may be configured to cause the rock drilling rig 100 to at least one of limit velocity or stop the rock drilling rig 100, in response to detecting the risk of instability.

In an embodiment, the apparatus 200 may be configured to monitor stability angles of the rock drilling rig 100. A stability angle may indicate an angle at which the rock drilling rig 100 may become unstable. The stability angles may comprise, for example, angles at which the total centre of gravity 302 is located outside the support pattern 300. When a stability angle reaches zero, the rock drilling rig 100 may lose stability. The stability angles may be monitored based on an arctangent function of a perpendicular distance of the total centre of gravity 302 to the edges of a support pattern 300 and a z-coordinate component of the total centre of gravity 302. For example, when the support pattern 300 is calculated based on positions of front wheels and a rear oscillation axle of the rock drilling rig 100 by the apparatus 200 (the support pattern 300 forms a triangle as shown in FIGS. 3 and 4), the apparatus 200 may be configured to compute the stability angles, for example, based on the perpendicular distance of the total centre of gravity 302 to the edges of the formed triangle support pattern 300. The apparatus 200 may be configured to cause velocity of the rock drilling rig 100 to be limited in response to detecting that a stability angle reaches a first predetermined value. The apparatus 200 may be configured to cause the rock drilling rig 100 to stop in response to detecting that a stability angle reaches a second predetermined value. The second predetermined value may be, for example, a zero angle, or close to zero.

An example embodiment enables to drive the rock drilling rig 100 in very small corners by turning the booms 104, while the apparatus 200 enables to reduce a risk of tipping. Although the rock drilling rig is used as an example, the apparatus 200 may be configured to monitor stability of any mining vehicle comprising sensors for monitoring positions of different parts of the mining vehicle.

Although in the examples the mining vehicle is operated by an operator, the mining vehicle 100 may be an autonomous mining vehicle. In an embodiment, the apparatus 200 may be configured to provide the data on stability of the mining vehicle to an autonomous control system of the mining vehicle. In an embodiment, the apparatus 200 may be configured to cause the mining vehicle to stop based on the information on stability of the mining vehicle indicating that a certain stability limit is reached. In an embodiment, the apparatus 200 may be configured to cause the mining vehicle to limit velocity based on the information on stability of the mining vehicle indicating that a certain stability limit is reached. For example, the apparatus 200 may be configured to send the information on stability to an autonomous driving system of the mining vehicle, which autonomous driving system may be configured to make the decision on stopping or reducing velocity.

Figure 5:
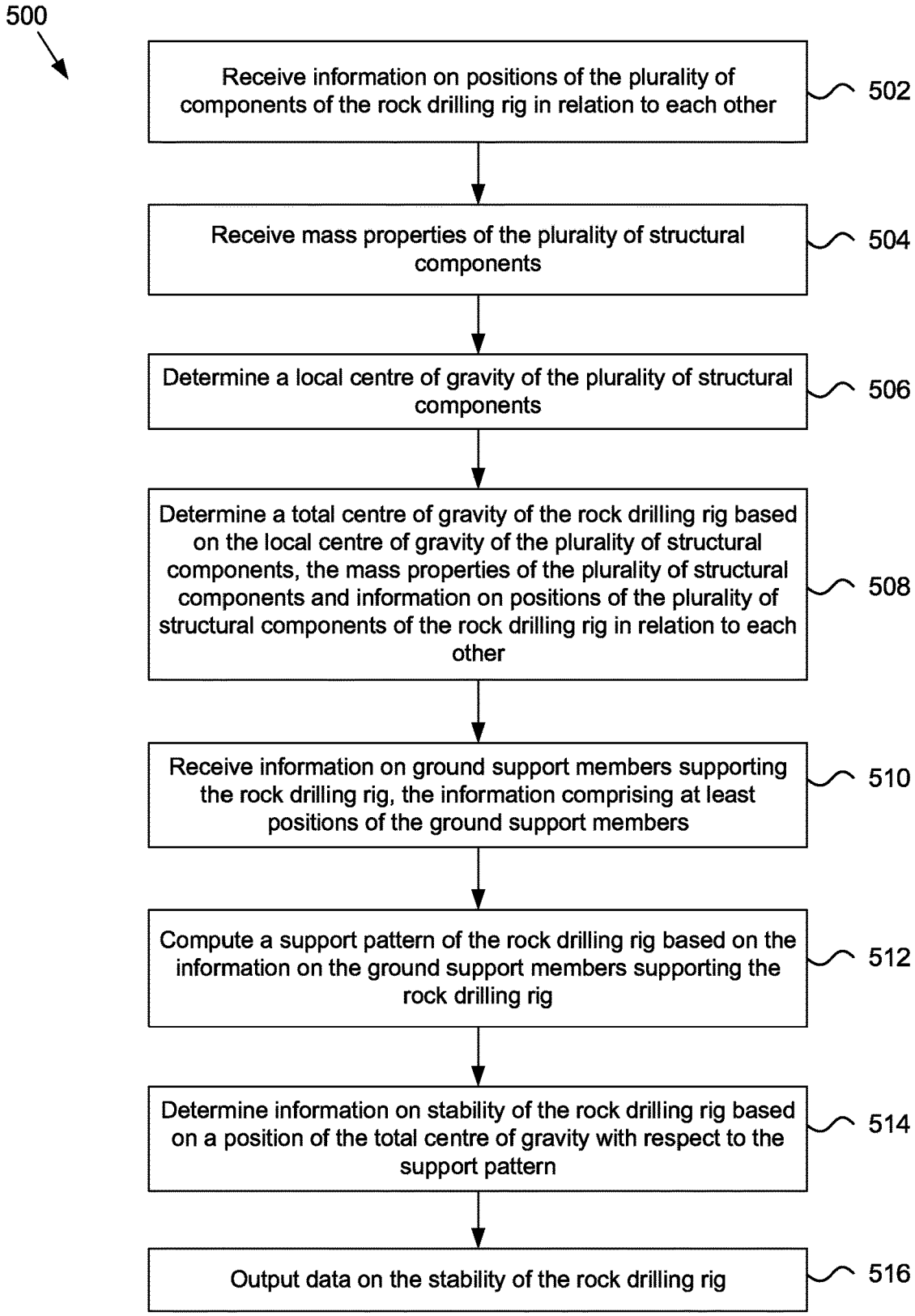
FIG. 5 illustrates an example of a method for monitoring a rock drilling rig, according to an example embodiment.

FIG. 5 illustrates an example of a method 500 for monitoring a mining vehicle, according to an example embodiment. The mining vehicle may be a rock drilling rig comprising a plurality of structural components.

At an operation 502, the method may comprise receiving information on positions of the plurality of structural components of the rock drilling rig in relation to each other. The structural components may comprise, for example, one or more carriers. The structural components may further comprise one or more booms.

At an operation 504, the method may comprise receiving mass properties of the plurality of structural components.

At an operation 506, the method may comprise determining a local centre of gravity of the plurality of structural components.

At an operation 508, the method may comprise determining a total centre of gravity of the rock drilling rig based on the local centre of gravity of the plurality of structural components, the mass properties of the plurality of structural components and information on positions of the plurality of structural components of the rock drilling rig in relation to each other.

At an operation 510, the method may comprise receiving information on ground support members supporting the rock drilling rig, the information comprising at least positions of the ground support members. The ground support members may comprise a plurality of wheels of the rock drilling rig. Alternatively, the ground support members may comprise one or more tracks of the rock drilling rig. The ground support members may further comprise a plurality of ground support cylinders. The ground support members may further comprise a rear oscillation axle.

At an operation 512, the method may comprise computing a support pattern of the rock drilling rig based on the information on the ground support members supporting the rock drilling rig.

At an operation 514, the method may comprise determining information on stability of the rock drilling rig based on a position of the total centre of gravity with respect to the support pattern.

At an operation 516, the method may comprise outputting data on the stability of the rock drilling rig. The outputted data may comprise a warning. The warning may be configured to instruct an operator of the rock drilling rig to limit velocity of the rock drilling rig. Alternatively, the warning may be configured to instruct the operator to stop the rock drilling rig. Content of the warning may depend on how close the location of the total centre of gravity is to at least one edge of the support pattern. Each warning may be based on a predetermined threshold for a distance between the location of the total centre of gravity and the at least one edge of the support pattern. In an embodiment, the rock drilling rig may be at least partially autonomous vehicle, and the rock drilling rig may be caused to limit its velocity or stop based on the information on stability of the rock drilling rig.

It is obvious to a person skilled in the art that with the advancement of technology, the basic idea of the invention may be implemented in various ways. The invention and its embodiments are thus not limited to the examples described above, instead they may vary within the scope of the claims.

Further features of the methods directly result from the functionalities and parameters of the apparatus as described in the appended claims and throughout the specification and are therefore not repeated here. It is noted that one or more operations of the method may be performed in different order.

An apparatus may be configured to perform or cause performance of any aspect of the method(s) described herein. Further, a computer program may comprise instructions for causing, when executed, an apparatus to perform any aspect of the method(s) described herein. Further, an apparatus may comprise means for performing any aspect of the method(s) described herein. According to an example embodiment, the means comprises at least one processor, and memory including program code, the at one memory and the program code configured to, when executed by the at least one processor, cause performance of any aspect of the method(s).

Any range or device value given herein may be extended or altered without losing the effect sought. Also, any embodiment may be combined with another embodiment unless explicitly disallowed.

Although the subject matter has been described in language specific to structural features and/or acts, it is to be understood that the subject matter defined in the appended claims is not necessarily limited to the specific features or acts described above. Rather, the specific features and acts described above are disclosed as examples of implementing the claims and other equivalent features and acts are intended to be within the scope of the claims.

It will be understood that the benefits and advantages described above may relate to one embodiment or may relate to several embodiments. The embodiments are not limited to those that solve any or all of the stated problems or those that have any or all of the stated benefits and advantages. It will further be understood that reference to 'an' item may refer to one or more of those items.

The operations of the methods described herein may be carried out in any suitable order, or simultaneously where appropriate. Additionally, individual blocks may be deleted from any of the methods without departing from the scope of the subject matter described herein. Aspects of any of the embodiments described above may be combined with aspects of any of the other embodiments described to form further embodiments without losing the effect sought.

The term 'comprising' is used herein to mean including the method, blocks, or elements identified, but that such blocks or elements do not comprise an exclusive list and a method or apparatus may contain additional blocks or elements.

As used in this application, the term 'circuitry' may refer to one or more or all of the following: (a) hardware-only circuit implementations (such as implementations in only analog and/or digital circuitry) and (b) combinations of hardware circuits and software, such as (as applicable): (i) a combination of analog and/or digital hardware circuit(s) with software/firmware and (ii) any portions of hardware processor(s) with software (including digital signal processor(s)), software, and memory(ies) that work together to cause an apparatus, such as a mobile phone or server, to perform various functions) and (c) hardware circuit(s) and or processor(s), such as a microprocessor(s) or a portion of a microprocessor(s), that requires software (e.g., firmware) for operation, but the software may not be present when it is not needed for operation. This definition of circuitry applies to all uses of this term in this application, including in any claims.

As a further example, as used in this application, the term circuitry also covers an implementation of merely a hardware circuit or processor (or multiple processors) or portion of a hardware circuit or processor and its (or their) accompanying software and/or firmware. The term circuitry also covers, for example and if applicable to the particular claim element, a baseband integrated circuit or processor integrated circuit for a mobile device or a similar integrated circuit in server, a cellular network device, or other computing or network device.

It will be understood that the above description is given by way of example only and that various modifications may be made by those skilled in the art. The above specification, examples and data provide a complete description of the structure and use of exemplary embodiments. Although various embodiments have been described above with a certain degree of particularity, or with reference to one or more individual embodiments, those skilled in the art could make numerous alterations to the disclosed embodiments without departing from scope of this specification.

The invention claimed is:

1. A computer-implemented method for monitoring a rock drilling rig, the method comprising:

receiving information on positions of a plurality of structural components of the rock drilling rig in relation to each other;

receiving mass properties of the plurality of structural components;

determining a local centre of gravity of the plurality of structural components;

determining a total centre of gravity of the rock drilling rig based on the local centre of gravity of the plurality of structural components, the mass properties of the plurality of structural components and information on positions of the plurality of structural components of the rock drilling rig in relation to each other;

receiving information on ground support members supporting the rock drilling rig, the information including at least positions of the ground support members;

computing a support pattern of the rock drilling rig based on the information on the ground support members supporting the rock drilling rig;

determining information on stability of the rock drilling rig based on a position of the total centre of gravity with respect to the support pattern;

detecting a risk of instability based on the information on stability of the rock drilling rig;

causing the rock drilling rig to at least one of limit velocity or stop when the risk of instability is detected; and outputting data on the stability of the rock drilling rig.

2. A non-transitory computer readable medium comprising computer program instructions, which, when executed by a computer, cause the computer to perform the method of claim 1.

3. An apparatus for monitoring a rock drilling rig including a plurality of structural components, the apparatus comprising:

at least one processor; and at least one memory comprising instructions, which, when executed by the at least one processor, cause the apparatus to:

receive information on positions of the plurality of structural components of the rock drilling rig in relation to each other;

receive mass properties of the plurality of structural components;

determine a local centre of gravity of the plurality of structural components;

determine a total centre of gravity of the rock drilling rig based on the local centre of gravity of the plurality of structural components, the mass properties of the plurality of structural components and information on positions of the plurality of structural components of the rock drilling rig in relation to each other;

receive information on ground support members supporting the rock drilling rig, the information comprising at least positions of the ground support members;

compute a support pattern of the rock drilling rig based on the information on the ground support members supporting the rock drilling rig;

determine information on stability of the rock drilling rig based on a position of the total centre of gravity with respect to the support pattern;

detect a risk of instability based on the information on stability of the rock drilling rig;

cause the rock drilling rig to at least one of limit velocity or stop when the risk of instability is detected; and output data on the stability of the rock drilling rig.

4. The apparatus of claim 3, wherein the at least one memory further comprises instructions, which, when executed by the at least one processor, cause the apparatus to:

receive information on a change of position of at least one first structural component of the plurality of structural components relative to at least one second structural component of the plurality of structural components; and update the total centre of gravity based on the information on the change of position.

5. The apparatus of claim 4, wherein the information on the change in position indicates at least one of translation movement or rotational movement of the first component relative to the second component.

6. The apparatus of claim 3, wherein the at least one memory further comprises instructions, which, when executed by the at least one processor, cause the apparatus to:

receive information on a change in position of at least one of the ground support members; and update the support pattern based on the information on the change in position of the at least one ground support member.

7. The apparatus of claim 3, wherein the plurality of structural components includes at least one carrier and at least one boom.

8. The apparatus of claim 3, wherein the plurality of structural components includes two carriers and each carrier includes a plurality of ground support members; and wherein the at least one memory further comprises instructions, which, when executed by the at least one processor, cause the apparatus to:

compute the support pattern of the rock drilling rig based on the information on the ground support members supporting the rock drilling rig and positions of the carriers in relation to each other.

9. The apparatus of claim 3, wherein the at least one memory further comprises instructions, which, when executed by the at least one processor, cause the apparatus to determine the information on stability of the rock drilling rig based on a distance between the total centre of gravity and at least one edge of the support pattern.

10. The apparatus of claim 3, wherein the at least one memory further comprises instructions, which, when executed by the at least one processor, cause the apparatus to determine the information on stability of the rock drilling rig based on a support force per each ground support member supporting the rock drilling rig.

11. The apparatus of claim 3, wherein the at least one memory further comprises instructions, which, when executed by the at least one processor, cause the apparatus to determine the information on stability of the rock drilling rig during operation of the rock drilling rig.

12. The apparatus of claim 3, wherein the ground support members supporting the rock drilling rig comprises at least one of tracks, wheels, a rear oscillation axle or ground support cylinders.

13. The apparatus of claim 10, wherein the at least one memory further comprises instructions, which, when executed by the at least one processor, cause the apparatus to detect the risk of instability based on the information on stability of the rock drilling rig indicating at least one of that a threshold value for a distance between the position of the total centre of gravity and at least one edge of the support pattern is met or that the support force per ground support member is below a predetermined threshold.

* * * * *